US010995581B2

(12) United States Patent
Joshi et al.

(10) Patent No.: US 10,995,581 B2
(45) Date of Patent: May 4, 2021

(54) SELF-CLEANING PACKER SYSTEM

(71) Applicant: Baker Hughes Oilfield Operations LLC, Houston, TX (US)

(72) Inventors: Mahendra Joshi, Katy, TX (US); Jeffrey Potts, Oklahoma City, OK (US); Reda El-Mahbes, Houston, TX (US); Dewey Parker, Jr., Oklahoma City, OK (US); Grant Hartman, Oklahoma City, OK (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 16/523,961

(22) Filed: Jul. 26, 2019

(65) Prior Publication Data

US 2020/0032612 A1 Jan. 30, 2020

Related U.S. Application Data

(60) Provisional application No. 62/703,558, filed on Jul. 26, 2018.

(51) Int. Cl.

| | |
|---|---|
| ***E21B 33/128*** | (2006.01) |
| ***E21B 33/12*** | (2006.01) |
| ***E21B 23/06*** | (2006.01) |
| *E21B 34/08* | (2006.01) |
| *E21B 34/06* | (2006.01) |

(52) U.S. Cl.

CPC ..... *E21B 33/128* (2013.01); *E21B 23/06* (2013.01); *E21B 33/1208* (2013.01); *E21B 33/1285* (2013.01); *E21B 34/063* (2013.01); *E21B 34/08* (2013.01)

(58) Field of Classification Search

CPC .. E21B 33/1208; E21B 33/128; E21B 33/126; E21B 33/1285; E21B 23/06; E21B 34/063; E21B 34/08

See application file for complete search history.

(56) References Cited

U.S. PATENT DOCUMENTS

| | | | | |
|---|---|---|---|---|
| 2,929,501 A | | 3/1960 | Fenske et al. | |
| 3,986,552 A | | 10/1976 | Scott | |
| 5,271,725 A | | 12/1993 | Freet et al. | |
| 5,433,269 A | * | 7/1995 | Hendrickson ..... | E21B 33/1208 166/134 |
| 5,660,533 A | | 8/1997 | Cartwright | |

(Continued)

FOREIGN PATENT DOCUMENTS

WO 2012169904 A2 12/2012

OTHER PUBLICATIONS

International Search Report and Written Opinion issued in connection with corresponding PCT Application No. PCT/US2019/43806 dated Oct. 21, 2019.

*Primary Examiner* — Nicole Coy

(74) *Attorney, Agent, or Firm* — Crowe & Dunlevy, P.C.

(57) ABSTRACT

A collapsible packer for use in a well includes a deployment assembly, a retraction assembly and a sealing assembly extending between the deployment assembly and the retraction assembly. The deployment assembly may include a spring and a degradable stop configured to offset the force applied by the spring. The degradable stop can be manufactured from a material that dissolves when contacted by fluid in the well. The retraction assembly may by hydraulically or spring energized.

18 Claims, 6 Drawing Sheets

(56) References Cited

U.S. PATENT DOCUMENTS 6,126,416 A 10/2000 Lee
6,186,227 B1 * 2/2001 Vaynshteyn ..... E21B 33/126 166/120
6,315,050 B2 * 11/2001 Vaynshteyn ..... E21B 33/126 166/376
6,564,876 B2 * 5/2003 Vaynshteyn ..... E21B 33/126 166/387
6,899,176 B2 5/2005 Hailey, Jr. et al.
7,387,158 B2 * 6/2008 Murray ..... E21B 33/1208 166/179
7,552,777 B2 * 6/2009 Murray ..... E21B 23/00 166/376
7,713,035 B2 5/2010 Ford
8,322,450 B2 * 12/2012 Meijer ..... E21B 33/1295 166/387
8,584,744 B2 11/2013 Soni et al.
8,998,586 B2 4/2015 Muhs
9,447,661 B2 9/2016 Broussard et al.
2002/0023750 A1 2/2002 Lopes et al.
2004/0020638 A1 2/2004 Williams
2004/0129432 A1 7/2004 Wills et al.
2004/0131488 A1 7/2004 Locher
2005/0199551 A1 9/2005 Gordon
2005/0281683 A1 12/2005 Brown et al.
2008/0093085 A1 4/2008 Knight et al.
2008/0110614 A1 5/2008 Orban
2009/0065202 A1 3/2009 Brown et al.
2010/0175869 A1 7/2010 Cobb
2010/0206732 A1 8/2010 Hale
2012/0057965 A1 3/2012 Bergamini et al.
2013/0025865 A1 1/2013 Knobloch et al.
2013/0075105 A1 3/2013 Morton
2013/0306330 A1 11/2013 Bishop et al.
2014/0332239 A1 11/2014 Porta
2015/0053394 A1 2/2015 Reid et al.
2015/0098840 A1 4/2015 Kowalchuk
2015/0167652 A1 6/2015 Van et al.
2015/0204158 A1 7/2015 Frisby et al.
2015/0275619 A1 10/2015 Slup
2015/0345276 A1 12/2015 Jensen
2016/0003031 A1 1/2016 Xin et al.
2016/0130919 A1 5/2016 Vasques
2016/0222770 A1 8/2016 Kirk et al.
2017/0241215 A1 8/2017 Kleppa
2017/0292361 A1 10/2017 Beauquin et al.
2017/0342798 A1 11/2017 Wutherich
2018/0112509 A1 4/2018 Saponja et al.
2018/0171763 A1 6/2018 Malbrel et al.
2018/0179852 A1 6/2018 Hou et al.
2018/0223642 A1 8/2018 Zahran
2018/0298736 A1 10/2018 Bailey et al.

* cited by examiner

SELF-CLEANING PACKER SYSTEM

RELATED APPLICATIONS

The present application claims the benefit of U.S. Provisional Patent Application Ser. No. 62/703,558 filed Jul. 26, 2018 and entitled, "Self-Cleaning Packer System," the disclosure of which is herein incorporated by reference.

FIELD OF THE INVENTION

This invention relates generally to oilfield equipment, and in particular to surface-mounted reciprocating-beam, rod-lift pumping units, and more particularly, but not by way of limitation, to beam pumping units used in connection with wells that produce significant sand and other sediments.

BACKGROUND

Hydrocarbons are often produced from wells with reciprocating downhole pumps that are driven from the surface by pumping units. A pumping unit is connected to its downhole pump by a rod string. Although several types of pumping units for reciprocating rod strings are known in the art, walking beam style pumps enjoy predominant use due to their simplicity and low maintenance requirements.

In many wells, a high gas-to-liquid ratio ("GLR") may adversely impact efforts to recover liquid hydrocarbons with a beam pumping system. Gas "slugging" occurs when large pockets of gas are expelled from the producing geologic formation over a short period of time. Free gas entering a downhole rod-lift pump can significantly reduce pumping efficiency and reduce running time. System cycling caused by gas can negatively impact the production as well as the longevity of the system.

Many rod pump systems include separators that discharge gas and sand into the annulus of the well. Discharging gas and sand into the annulus generally improves the performance of the downhole pump. Over time, however, the sand accumulates in the annulus around downhole components, particularly in lateral portions of the well. The sand deposits may frustrate efforts to retrieve the downhole pumping components from the well. Packers, plugs and other zone isolation devices are especially vulnerable to sand packing. There is, therefore, a need for an improved packer system that overcomes these and other deficiencies of the prior art.

SUMMARY OF THE INVENTION

In one aspect, embodiments of the present invention include a collapsible packer for use in a well. The packer includes a deployment assembly, a retraction assembly and a sealing assembly extending between the deployment assembly and the retraction assembly. The deployment assembly may include a spring and a degradable stop configured to offset the force applied by the spring. The degradable stop can be manufactured from a material that dissolves when contacted by fluid in the well.

In some embodiments, the retraction assembly may include a pressure housing, a retraction piston inside the pressure housing, an orifice extending through the pressure housing, and a rupture plate covering the orifice. The rupture plate is configured to rupture and open the orifice when exposed to external fluid pressure exceeding a predetermined rupture pressure. In other embodiments, the retraction assembly includes a retraction spring that is captured by a shear pin that is connected to a velocity tube or other tubular extending through the collapsible packer. The shear pin is designed to breaks under shear stress created by attempting to remove the tubular from the deployed collapsible packer. When the shear pin fails, the retraction spring releases the compression applied to the sealing assembly to allow the collapsible packer to collapse.

In another aspect, the invention includes a method for deploying and removing a packer in a well. The method includes the steps of providing a packer having a deployment assembly, a sealing assembly and a retraction assembly, connecting the packer to a tubular body and placing the packer and tubular body at a desired location in the well. The method continues with the steps of activating the deployment assembly to expand the sealing assembly, activating the retraction assembly to collapse the sealing assembly, and removing the collapsed packer and tubular body from the desired location in the well.

WRITTEN DESCRIPTION

Figure 1:
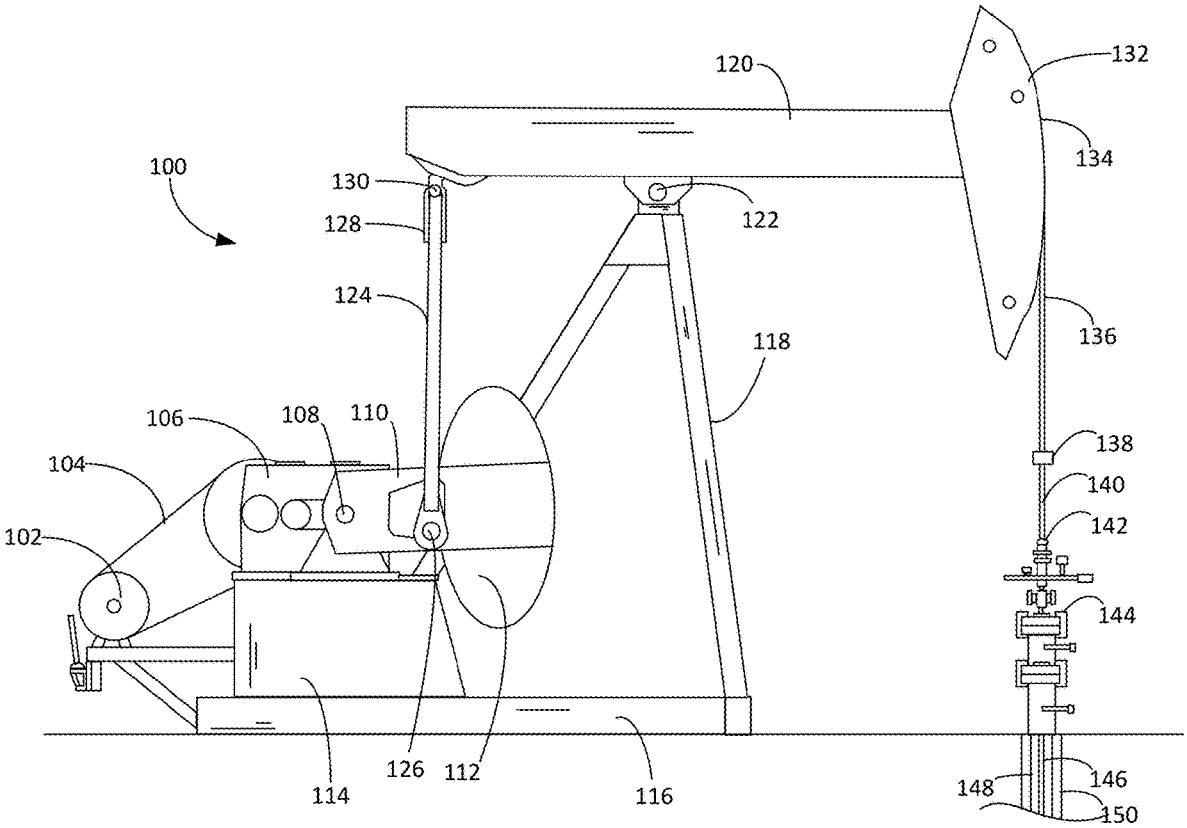
FIG. 1 is a side view of a beam pumping unit and well.

FIG. 1 shows a beam pump 100 constructed in accordance with an exemplary embodiment of the present invention. The beam pump 100 is driven by a prime mover 102, typically an electric motor or internal combustion engine. The rotational power output from the prime mover 102 is transmitted by a drive belt 104 to a gearbox 106. The gearbox 106 provides low-speed, high-torque rotation of a crankshaft 108. Each end of the crankshaft 108 (only one is visible in FIG. 1) carries a crank arm 110 and a counterbalance weight 112. The reducer gearbox 106 sits atop a sub-base or pedestal 114, which provides clearance for the crank arms 110 and counterbalance weights 112 to rotate. The gearbox pedestal 114 is mounted atop a base 116. The base 116 also supports a Samson post 118. The top of the Samson post 118 acts as a fulcrum that pivotally supports a walking beam 120 via a center bearing assembly 122.

Each crank arm 110 is pivotally connected to a pitman arm 124 by a crank pin bearing assembly 126. The two pitman arms 124 are connected to an equalizer bar 128, and the equalizer bar 128 is pivotally connected to the rear end of the walking beam 120 by an equalizer bearing assembly 130, commonly referred to as a tail bearing assembly. A horse head 132 with an arcuate forward face 134 is mounted to the forward end of the walking beam 120. The face 134 of the horse head 132 interfaces with a flexible wire rope bridle 136. At its lower end, the bridle 136 terminates with a carrier bar 138, upon which a polish rod 140 is suspended. The polish rod 140 extends through a packing gland or stuffing box 142 on a wellhead 144. A rod string 146 of sucker rods hangs from the polish rod 140 within a tubing string 148 located the in the casing 150 of a well 152.

Figure 2A:
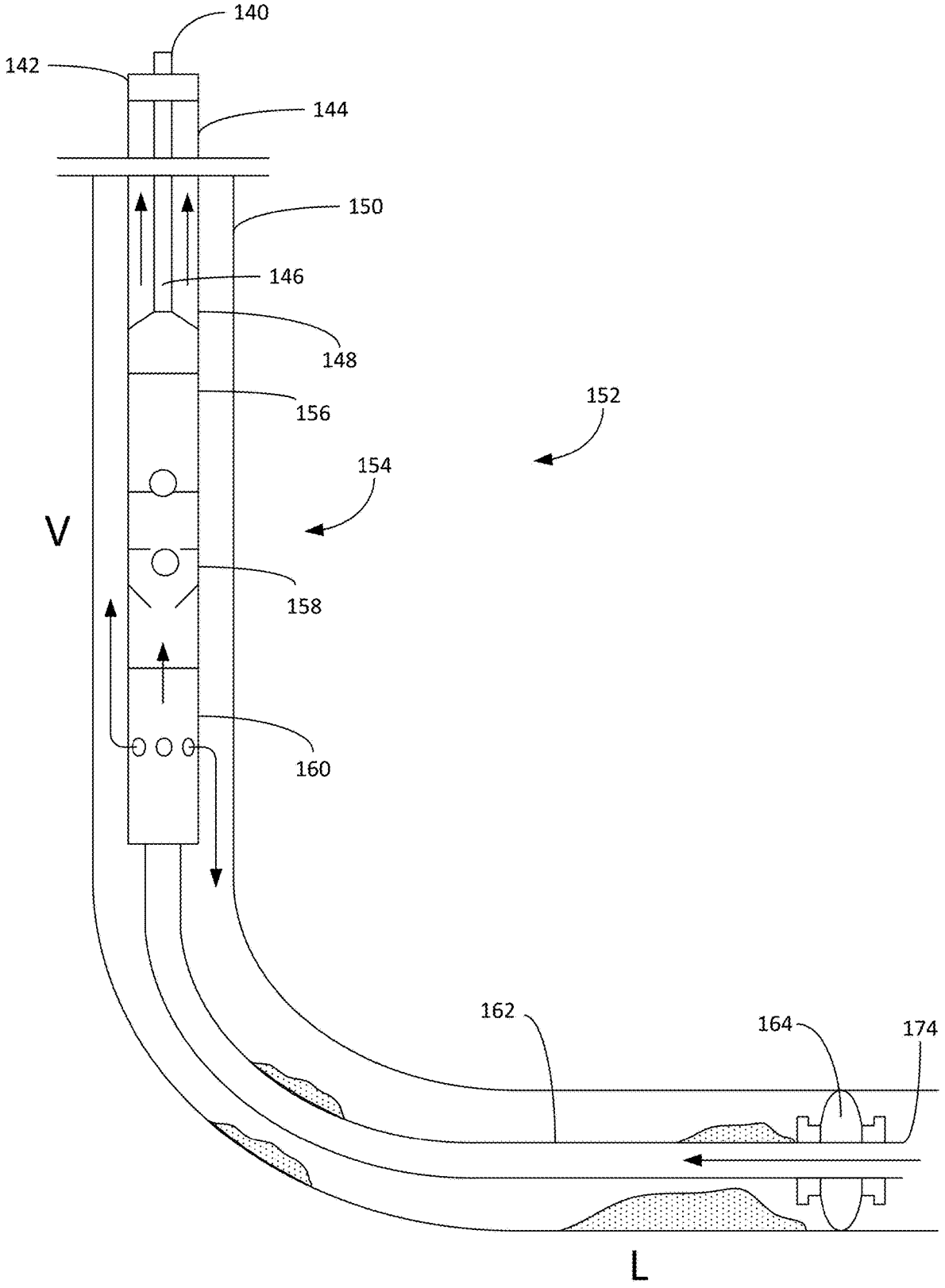
FIG. 2A is a depiction of an exemplary embodiment of the collapsible packer system deployed in connection with a first embodiment of the pumping system.
Figure 2B:
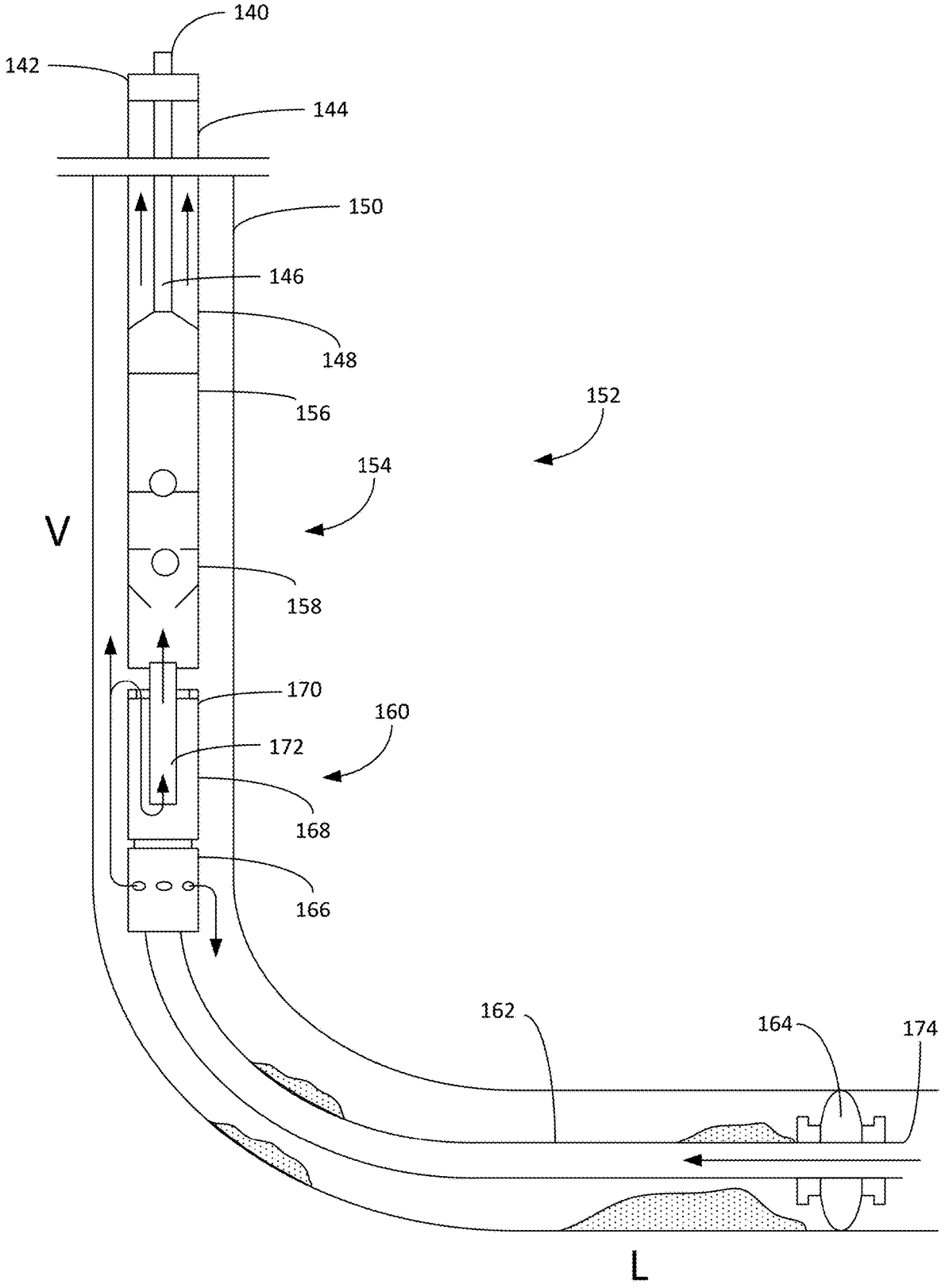
FIG. 2B is a depiction of an exemplary embodiment of the collapsible packer system deployed in connection with a second embodiment of the pumping system.

Turning to FIGS. 2A and 2B, shown therein is a depiction of the well 152. As depicted, the well 152 has a vertical portion (V) and a lateral portion (L). A subsurface pump 154 is disposed in the well casing 150 and configured to lift fluids from the well 152 to the surface through the tubing string 148. The subsurface pump 154 can be configured as a rod pump that includes a traveling valve 156 and a standing valve 158. The rod string 146 is connected to the traveling valve 156. In a reciprocating cycle of the beam pump 100, well fluids are lifted by the traveling valve 156 within the tubing string 148 during the upstroke of the rod string 146.

The subsurface pump 154 further includes an intake separator 160, a velocity tube 162 and a collapsible packer 164. In FIG. 2A, the intake separator 160 is connected between the velocity tube 162 and the standing valve 158. Generally, the intake separator 160 expels sand and gas into the annular space between the well casing 150 and the subsurface pump 154. The gas tends to rise through the well 152, while the solid particles fall back into the lower and lateral portions of the well 152. The intake separator 160 may employ cyclonic mechanisms to separate the sand and gas components of the fluid entering the standing valve 158.

In FIG. 2B, the intake separator 160 is configured as a two-step separation system that includes a perforated joint 166 and a gas mitigation canister 168. Gases, liquids and solids delivered to the perforated joint 166 through the velocity tube 162 are expelled into the annulus surrounding the subsurface pump 154. Sand and other solids fall to the lower portions of the well 152, while the gases and liquids rise. The gas mitigation canister 168 has an open top 170 to permit liquids to enter the gas mitigation canister 168. There, the liquids are drawn into the standing valve 158 through an inlet tube 172. In this way, the gas mitigation canister 168 and perforated joint 166 rely on gravity to reduce the fraction of gas and solids drawn into the standing valve 158.

As depicted in FIGS. 2A and 2B, the velocity tube 162 extends around the heel into the lateral portion (L) of the well 152. The velocity tube 162 includes an open end 174 that permits the introduction of fluids into the velocity tube 162. The collapsible packer 164 is positioned around the velocity tube 162 at a desired location in the well 160 to prevent or reduce the movement of fluids in the annular space between the velocity tube 162 and the well casing 150. Although the collapsible packer 164 is depicted as being deployed in the lateral portion (L) of the well 152, it will be appreciated that in other embodiments, the collapsible packer 164 can be deployed in the vertical portion (V) or heel of the well 152. Although a single collapsible packer 164 is depicted in FIGS. 2A and 2B, it will be understood that additional collapsible packers 164 could also be deployed within the well 152.

Figure 3A:
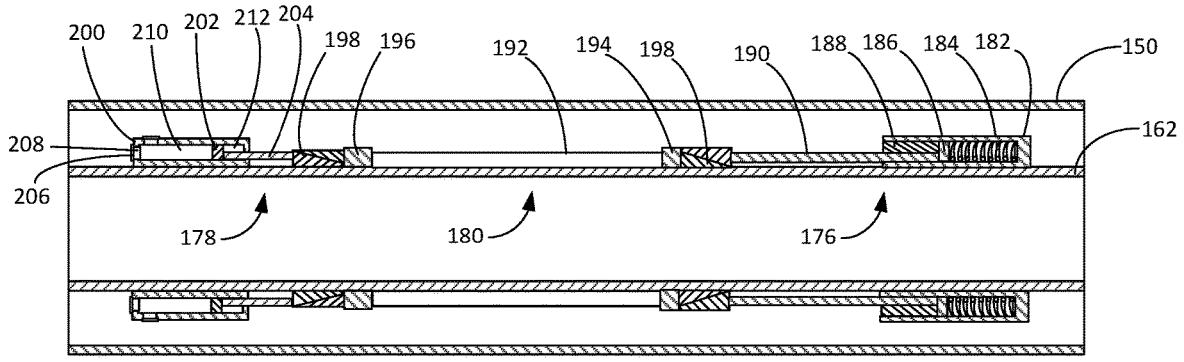
FIG. 3A is a side cross-sectional view of the collapsible packer from FIG. 2 in an installation state.
Figure 3B:
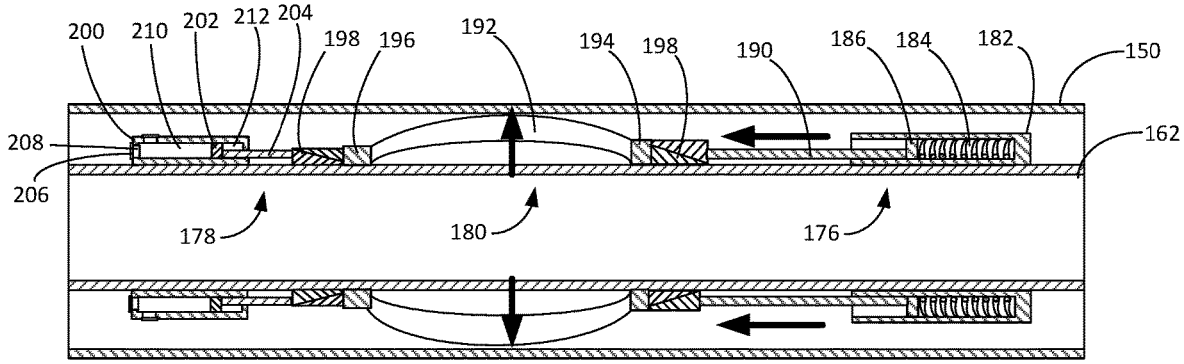
FIG. 3B is a side cross-sectional view of the collapsible packer from FIG. 2 in a deployed state during operation of the pumping system.
Figure 3C:
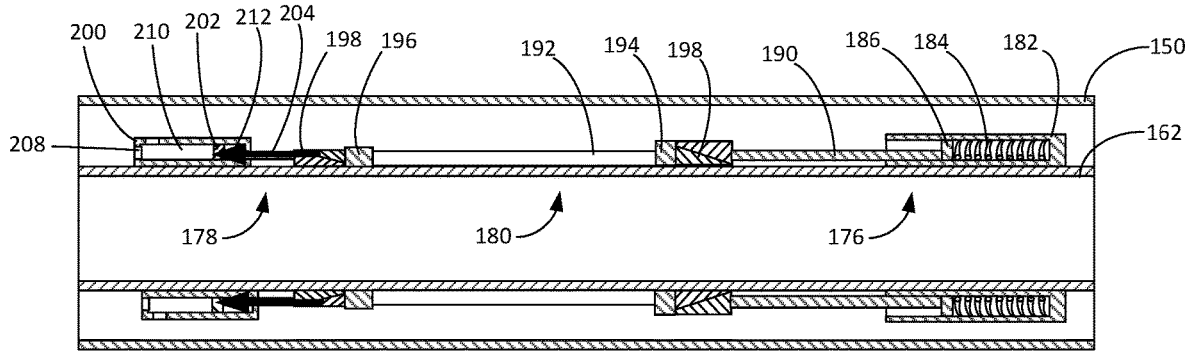
FIG. 3C is a side cross-sectional view of the collapsible packer from FIG. 2 in a collapsed state to facilitate retrieval of the downhole components.

Turning to FIGS. 3A, 3B and 3C, shown therein are cross-sectional depictions of the collapsible packer 164 in various stages of operation. The collapsible packer 164 includes a deployment assembly 176, a retraction assembly 178 and a sealing assembly 180 disposed between the deployment assembly 176 and the retraction assembly 178. The deployment assembly 176 and retraction assembly 178 are connected to the velocity tube 162 at a desired location. The deployment assembly 176 includes a spring housing 182, a deployment spring 184, a deployment piston 186, a stop 188 and a deployment piston sleeve 190. It will be appreciated that although shown in cross-section in FIGS. 3A-3C, each of these components may have a substantially cylindrical form that surrounds the velocity tube 162.

The deployment piston 186, stop 188 and deployment spring 184 are each contained within the spring housing 182. The deployment piston 186 is connected to the deployment piston sleeve 190, which extends through the spring housing 182 to the sealing assembly 180. The collapsible packer 164 may include a single deployment spring 184 or multiple deployment springs 184 within the spring housing 182. Initially, as depicted in FIG. 3A, the movable deployment piston 186 is captured and held stationary within the spring housing 182 between the stop 188 and the deployment spring 184. In this way, the stop 188 opposes the force applied to the deployment piston 186 by the deployment spring 184. In some embodiments, the spring housing 182 includes ports (not shown) that expose the stop 188 to fluids in the well 152. In other embodiments, the opening in the spring housing 182 that permits movement of the deployment piston sleeve 190 is sufficiently large to allow fluids from the well 150 to enter into the spring housing 182.

The stop 188 is constructed from a material that dissolves or disintegrates in the presence of fluids in the well 152. Suitable materials of construction should be selected based on the predicted chemistry, temperature, pressure, composition and condition of the fluids in the well 152. Materials of construction generally include, but are not limited to, oxo-degradable polymers, polymers with hydrolysable backbones (e.g., aliphatic polyesters) including hydrolysable polymers produced from animal sources (e.g., collagen and chitin). In other embodiments, the material of construction may be chosen from biodegradable polymers including polylactide (PLA), poly-L-lactide (PLLA), and polyglycolic acid (PGA). Additionally, powders or nanoparticles of reactive transition metals such as manganese can be dispersed within the aforementioned polymers or other suitable polymer matrices to create degrading polymer composite materials. It will be further appreciated that the stop 188 may also be manufactured from metals and metal alloys that are designed to react with water, acids, brines and dissolved oxygen that may be present in the well 152. In a preferred embodiment, the stop 188 would be manufactured from high-strength engineered composite materials that degrade by electrolytic processes, such as the composite materials commercialized by Baker Hughes Incorporated under the IN-TALLIC® brand, which have been used in other downhole components such as isolation plugs for hydraulic fracturing.

In each case, the stop 188 is manufactured and configured to degrade over a desired period. The stop 188 is configured to deteriorate over a period that provides sufficient time to properly place the collapsible packer 164 within the well 152. As the stop 188 deteriorates, the deployment spring 184 pushes the deployment piston 186 and deployment piston sleeve 190 toward the sealing assembly 180. As depicted in FIG. 3B, the stop 188 has completely deteriorated and the deployment piston 186 and deployment piston sleeve 190 have been completely deployed.

The sealing assembly 180 includes a flexible seal 192 captured between first and second end flanges 194, 196. In exemplary embodiments, the flexible seal 192 is constructed from an elastomer sleeve composed of a high-strength rubber such as nitrile rubber (NBR), hydrogenated nitrile rubber (HNBR), a fluoroelastomer or perfluoroelastomer. These rubber materials and composites thereof can be formulated to be inert to fluids present in well 152 and maintain sealing force under the buckling load created between end flanges 194 and 196. The flexible seal 192 is configured to buckle outward (as depicted in FIGS. 3B and 4B) when placed under compression between the first and second end flanges 194, 196. The flexible seal 192 may include a cross-sectional profile and contour that facilitates a substantially parabolic buckling mode. To further encourage the outward buckling of the flexible seal 192, the first and second end flanges 194, 196 may include a buckling force ramp 198 that directs the compressive force into the flexible seal 192 at an outward angle to promote a parabolic expansion of the flexible seal 192 against the well casing 150.

Figure 5A:
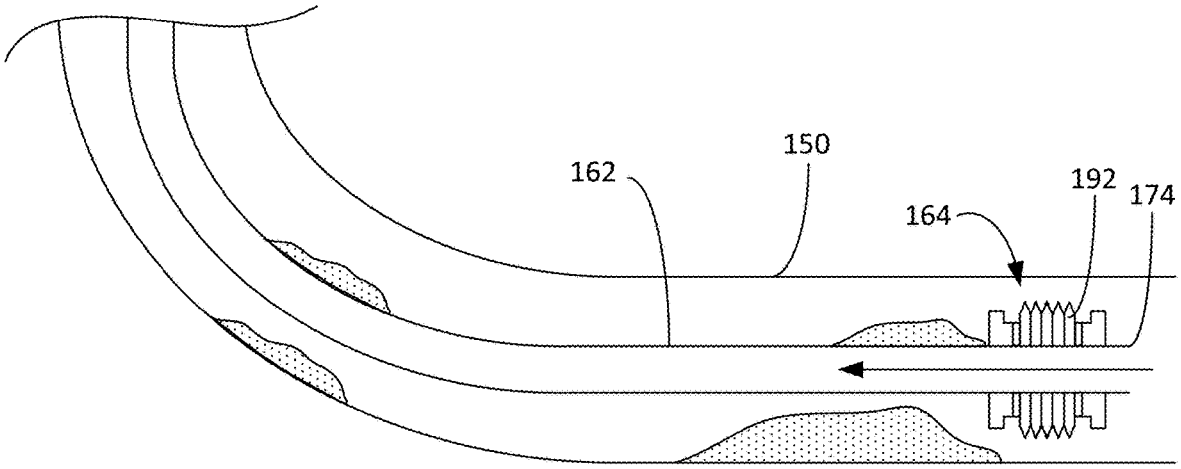
FIG. 5A is a side depiction of an embodiment of the collapsible packer in which the sealing assembly includes an expandable bellows in a retracted state.
Figure 5B:
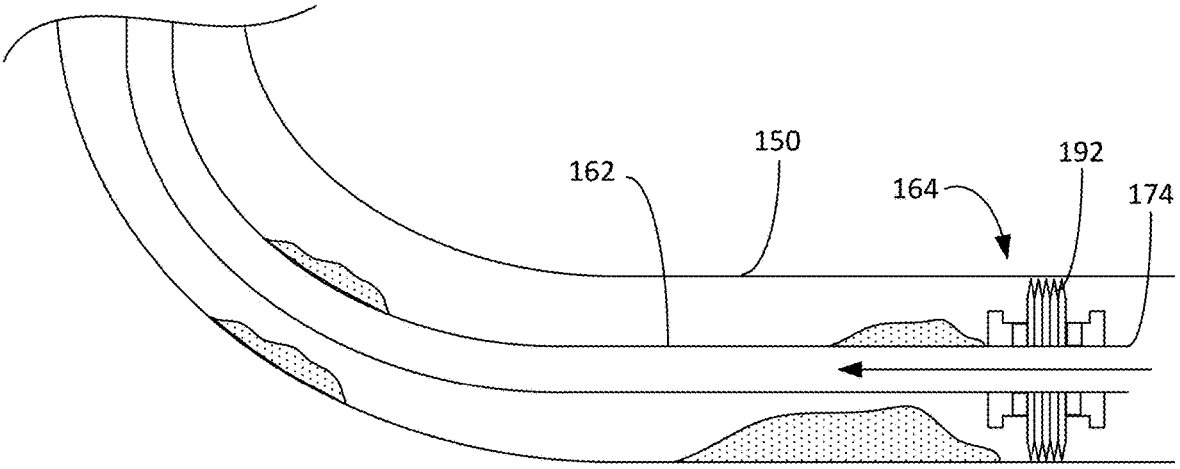
FIG. 5B is a side depiction of an embodiment of the collapsible packer in which the sealing assembly includes an expandable bellows in a deployed state.

In the embodiment depicted in FIGS. 5A and 5B, the flexible seal 192 is configured as an expandable "bellows" or encased coil spring which has relatively smaller sealing diameter in a laterally expanded state and a larger sealing diameter in a laterally compressed state. The benefits of using a bellow shape for the flexible seal 192 include having multiple sealing surfaces between collapsible packer 164 and well casing 150. This configuration will ensure seal integrity and provides redundancy in the event of partial failure of the sealing material. The basic concept for sealing comprises multiple flexible seals in the shape of a bellows and configured to buckle outward and expand under a compressive load produced by the deployment assembly 176 and to retract when the compressive load is removed by the retraction assembly 178.

The retraction assembly 178 offsets the force transferred through the expanding flexible seal 192 from the deployment spring 184. In a first embodiment depicted in FIGS. 3A-3C, the retraction assembly 178 includes a pressure housing 200, a retraction piston 202, a retraction piston sleeve 204, rupture plates 206 and orifices 208. The retraction piston 202 is captured within the pressure housing 200 and separates the pressure housing 200 into a first chamber 210 and a second chamber 212. The retraction piston sleeve 204 extends from retraction piston 202 to the second end flange 196 of the sealing assembly 180. The orifices 208 connect with the first chamber 210 and are initially blocked by the rupture plates 206.

During manufacture, the first chamber 210 and second chamber 212 are filled with fluid and pressurized around the retraction piston 202. The fluid pressure within the first chamber 210 prevents the retraction piston 202 from moving outward when exposed to the force of the deployment spring 184 through the flexible seal 192. The rupture plates 206 are configured to fail when exposed to an external rupture pressure in the well 152. The rupture pressure can be achieved by forcing fluids into the well 152 under elevated pressure. In exemplary embodiments, the rupture pressure is achieved by forcing a pressurized nitrogen mixture or other gas mixture into the well 152. When the pressure in the well 152 exceeds the predetermined rupture pressure, the rupture plates 152 will fail, thereby opening the orifices 208 and placing the first chamber 210 in fluid communication with the well 152. When the induced rupture pressure is released, the pressurized fluid in the first chamber 210 of the pressure housing 200 will be released through the orifices 208 into the well 152. The pressure within the second chamber 212 creates a pressure gradient across the retraction piston 202 that forces the retraction piston 202, retraction piston sleeve 204 and second end flange 196 outward to remove the compressive force on the flexible seal 192. It will be appreciated that spring force captured in the expanded flexible seal 192 will assist in driving the retraction piston 202 into a retracted position.

As shown in FIG. 3C, the retraction piston 202 has been pushed outward and the flexible seal 192 has returned to an unstressed, collapsed state. In this condition, the collapsible packer 164 and velocity tube 162 can be more easily retrieved from the sand-impacted well 152.

Figure 4A:
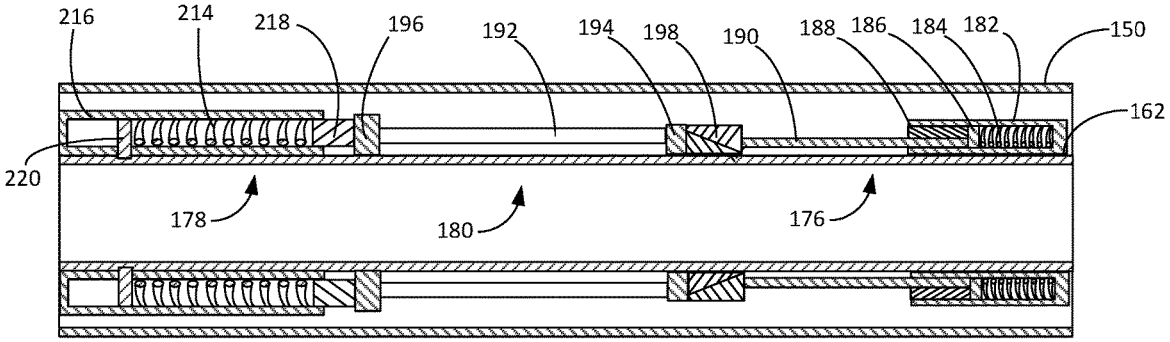
FIG. 4A is a side cross-sectional view of a second embodiment of the collapsible packer from FIG. 2 in an installation state.
Figure 4B:
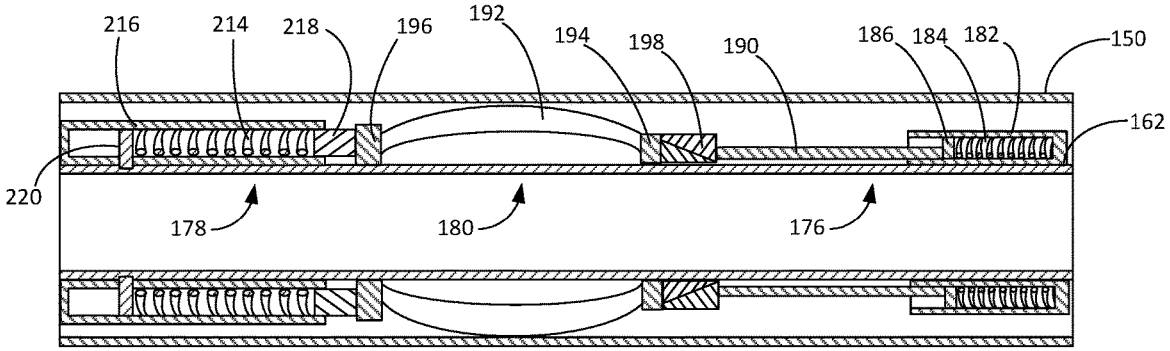
FIG. 4B is a side cross-sectional view of the collapsible packer from FIG. 4A in a deployed state during operation of the pumping system.
Figure 4C:
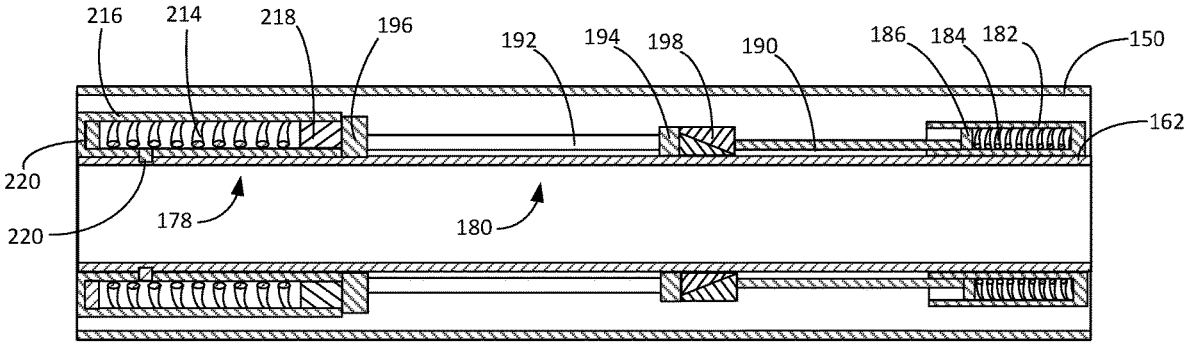
FIG. 4C is a side cross-sectional view of the collapsible packer from FIG. 4A in a collapsed state to facilitate retrieval of the downhole components.

In a second embodiment depicted in FIGS. 4A-4C, the retraction assembly 178 is spring-driven and includes a retraction spring 214 in a retraction spring housing 216. A first end of the retraction spring 214 is connected to a retraction spring piston 218 that is also connected to the flexible seal 192. A second end of the retraction spring 214 is temporarily held in place by a shear pin 220. It will be appreciated that a plurality of shear pins 220 can be used to secure the second end of the retraction spring 214. The collapsible packer 164 may include a single retraction spring 214 or multiple deployment springs 214 within the retraction spring housing 216.

During assembly, the shear pin 220 extends through the retraction spring housing 216 into the velocity tube 162. The shear pin 220 prevents the second end of the retraction spring 214 from moving backward within the retraction spring housing 216. When the deployment assembly 176 activates and exerts a compressive force on the flexible seal 192, the retraction spring 214 is compressed against the shear pin 220, as illustrated in FIG. 4B. In this deployed state, deployment spring 182 and retraction spring 214 provide balanced and offsetting forces that are calculated to force the flexible seal 192 to buckle outward against the well casing 150.

When it is time to remove the subsurface pump 154, it is pulled in a direction outward from the well 152. Because the collapsible packer 164 remains expanded, it opposes the withdrawal of the velocity tube 162. The movement of the velocity tube 162 relative to the stationary collapsible packer 164 creates a shear force about the shear pin 220, which fails when exposed to shear stress that exceeds its maximum shear strength. Once the shear pin 220 fails, it allows the retraction spring 214 to expand within the retraction spring housing 216, as shown in FIG. 4C. This reduces the compressive forces supplied by the retraction spring 214 and allows the flexible seal 192 to collapse. This facilitates the removal of the subsurface pump 154 from the well 152.

Thus, the exemplary embodiments provide a method and mechanism for selectively installing, remotely expanding, remotely collapsing and retrieving a packer from a well. It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A packer for use in a well, the packer comprising:
a deployment assembly;
a retraction assembly, wherein the retraction assembly comprises:
a pressure housing, wherein the pressure housing has an interior chamber and an exterior chamber;
a retraction piston inside the pressure housing between the interior chamber and the exterior chamber;
an orifice extending through the pressure housing into the exterior chamber; and
a rupture plate covering the orifice, wherein the rupture plate is configured to rupture and open the orifice when exposed to external fluid pressure exceeding a predetermined rupture pressure; and
a sealing assembly extending between the deployment assembly and the retraction assembly.

2. The packer of claim 1, wherein the sealing assembly comprises a flexible seal that is configured to buckle outward under a compressive load.

3. The packer of claim 2, wherein the deployment assembly further comprises:
a deployment piston; and
a spring that exerts force against the deployment piston.

4. The packer of claim 3, wherein the deployment assembly further comprises a degradable stop configured to offset the force applied by the spring against the deployment piston, wherein the degradable stop is manufactured from a material that dissolves or disintegrates when contacted by fluid in the well.

5. The packer of claim 4, wherein the deployment assembly further comprises a deployment piston sleeve that extends from the deployment piston and transfers force from the spring to the sealing assembly when the degradable stop has dissolved.

6. The packer of claim 2, wherein the sealing assembly further comprises:
a first end flange;
a second end flange;
one or more buckling force ramps adjacent each of the first and second end flanges; and
wherein the flexible seal extends between the first and second end flanges.

7. The packer of claim 2, wherein the retraction assembly comprises:
a retraction spring housing;
a retraction spring contained within the retraction spring housing, wherein the retraction spring is configured to apply a compressive to the sealing assembly; and
a shear pin extending through the retraction spring housing to hold the retraction spring in place.

8. The packer of claim 1, wherein the retraction assembly further comprises a retraction piston sleeve extending from the retraction piston to the sealing assembly.

9. A method for deploying and removing a packer in a well that contains a subsurface pump, the method comprising the steps of:
providing a packer having a deployment assembly, a sealing assembly and a retraction assembly;
connecting the packer to a tubular body;
placing the packer and tubular body at a desired location in the well;
activating the deployment assembly to expand the sealing assembly;
activating the retraction assembly to collapse the sealing assembly, wherein the step of activating the retraction assembly further comprises the steps of:
moving the tubular body relative to the expanded sealing assembly;
breaking a shear pin connected between the retraction assembly and the tubular body;
releasing a spring force applied to the sealing assembly by the retraction assembly; and
allowing the sealing assembly to collapse; and
removing the packer and tubular body from the desired location in the well.

10. The method of claim 9, wherein the step of connecting the packer to a tubular body comprises connecting the packer to a velocity tube that is connected to an intake separator of the subsurface pump.

11. The method of claim 9, wherein the step of activating the deployment assembly further comprises the steps of:
using well fluids to dissolve or disintegrate a degradable stop to release a spring force captured within the deployment assembly;
applying the spring force against a deployment piston within the deployment assembly; and
transferring the spring force to the sealing assembly to expand the sealing assembly.

12. A method for deploying and removing a packer in a well that contains a subsurface pump, the method comprising the steps of:
providing a packer having a deployment assembly, a sealing assembly and a retraction assembly;
connecting the packer to a tubular body;
placing the packer and tubular body at a desired location in the well;
activating the deployment assembly to expand the sealing assembly;
activating the retraction assembly to collapse the sealing assembly; wherein the step of activating the retraction assembly further comprises the steps of:
increasing the external pressure surrounding the retraction assembly to a pressure that exceeds a predetermined rupture pressure;
rupturing a rupture plate in the retraction assembly to expose an orifice extending into a first chamber of a pressure housing within the retraction assembly;
venting pressurized fluid from a first chamber in the pressure housing into the well; and
applying hydraulic pressure from a second chamber in the pressure housing against a retraction piston to force the retraction piston to collapse the sealing assembly; and
removing the packer and tubular body from the desired location in the well.

13. A packer for use in a well, the packer comprising:
a deployment assembly, wherein the deployment assembly comprises:
a deployment piston; and
a spring that exerts force against the deployment piston;
a retraction assembly, wherein retraction assembly comprises:
a pressure housing that has an interior chamber and an exterior chamber; and
a retraction piston inside the pressure housing between the interior chamber and the exterior chamber; and
a sealing assembly extending between the deployment assembly and the retraction assembly, wherein the sealing assembly comprises a flexible seal that is configured to buckle outward under a compressive load.

14. The packer of claim 13, wherein the deployment assembly further comprises a degradable stop configured to offset the force applied by the spring against the deployment piston, wherein the degradable stop is manufactured from a material that dissolves or disintegrates when contacted by fluid in the well.

15. The packer of claim 14, wherein the deployment assembly further comprises a deployment piston sleeve that extends from the deployment piston and transfers force from the spring to the sealing assembly when the degradable stop has dissolved.

16. The packer of claim 13, wherein the retraction assembly further comprises:

an orifice extending through the pressure housing into the exterior chamber; and a rupture plate covering the orifice, wherein the rupture plate is configured to rupture and open the orifice when exposed to external fluid pressure exceeding a predetermined rupture pressure.

17. The packer of claim 13, wherein the retraction assembly further comprises a retraction piston sleeve extending from the retraction piston to the sealing assembly.

18. The packer of claim 13, wherein the retraction assembly comprises:

a retraction spring housing;

a retraction spring contained within the retraction spring housing, wherein the retraction spring is configured to apply a compressive to the sealing assembly; and a shear pin extending through the retraction spring housing to hold the retraction spring in place.

* * * * *